US006785938B1

(12) United States Patent
Johansen, Jr.

(10) Patent No.: US 6,785,938 B1
(45) Date of Patent: Sep. 7, 2004

(54) PET CREMATORY URN

(75) Inventor: Charles J. Johansen, Jr., Katy, TX (US)

(73) Assignee: C-Cure Corporation, Katy, TX (US)

( * ) Notice: Subject to any disclaimer, the term of this patent is extended or adjusted under 35 U.S.C. 154(b) by 0 days.

(21) Appl. No.: 10/431,266

(22) Filed: May 7, 2003

(51) Int. Cl.[7] ..... A61G 17/00
(52) U.S. Cl. ..... 27/1
(58) Field of Search ..... 27/1, 19; D99/5

(56) References Cited

U.S. PATENT DOCUMENTS

| | | | | | |
|---|---|---|---|---|---|
| 232,782 | A | | 9/1880 | Townsend | |
| 1,558,278 | A | | 12/1923 | Phillips | |
| 1,660,085 | A | | 8/1926 | Nassau | |
| 2,075,859 | A | | 9/1936 | Martin | |
| 2,235,617 | A | * | 3/1941 | Klinzing | 220/288 |
| 2,385,520 | A | * | 9/1945 | Klinzing | 27/1 |
| 2,562,726 | A | * | 7/1951 | Macdonald | 27/1 |
| 2,618,892 | A | | 11/1952 | Locks et al. | |
| 4,324,026 | A | | 4/1982 | Craft | |
| 4,816,000 | A | * | 3/1989 | Hsu | 446/74 |
| 5,326,300 | A | | 7/1994 | Sonders | |
| 5,386,909 | A | * | 2/1995 | Spector | 206/457 |
| 5,676,583 | A | | 10/1997 | Wang et al. | |
| 5,702,003 | A | | 12/1997 | Springer | |
| D398,733 | S | | 9/1998 | Diviak, Sr. | |
| 6,023,822 | A | * | 2/2000 | Luebke | 27/1 |
| 6,223,404 | B1 | * | 5/2001 | Fant et al. | 27/19 |

FOREIGN PATENT DOCUMENTS

CN 1240723 A * 1/2000 ..... B44C/3/06

OTHER PUBLICATIONS

Techsoft Roland Modela, 3D Scanning and Modelling/ Milling in one Low Cost Machine, Website. (undated).
CrematoryUrns.com, Pet Urns & Memorials, Website. (2001).
IDM 3D Grey Scale for CNC Machines, 3D Laser Mapping to CNC Replication IDM Image Data Matrix, Website. (undated).

* cited by examiner

*Primary Examiner*—William L. Miller
(74) *Attorney, Agent, or Firm*—Hedman & Costigan, P.C.

(57) ABSTRACT

A pet crematory urn for storing the cremated remains of a deceased pet where a decorative figure in the nearly exact likeness of the deceased pet provides a sealable repository chamber for receiving cremated remains of a deceased pet. The pet urn, optionally, may rest upon a supporting base, where the sealable repository chamber is a drawer in the supporting base that is adapted to receive said cremated remains.

5 Claims, 2 Drawing Sheets

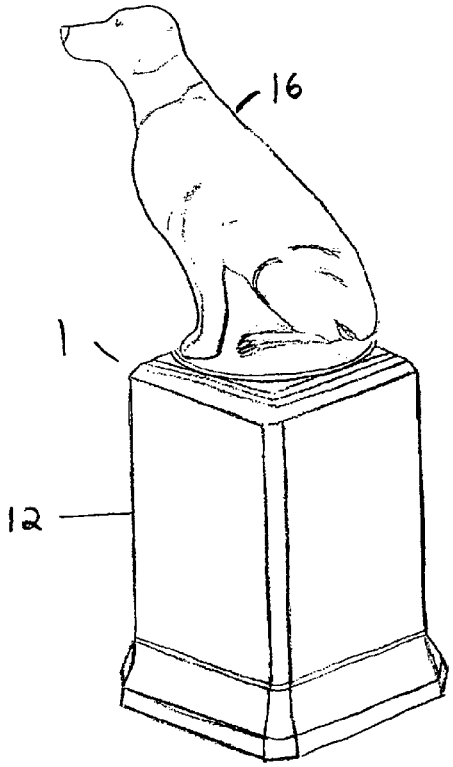
Fig. 5
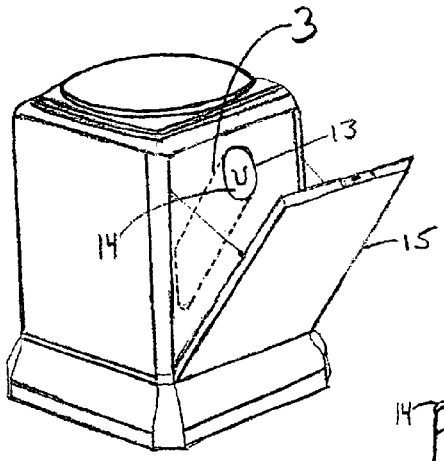
Fig. 6
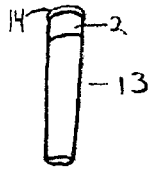
Fig 6a
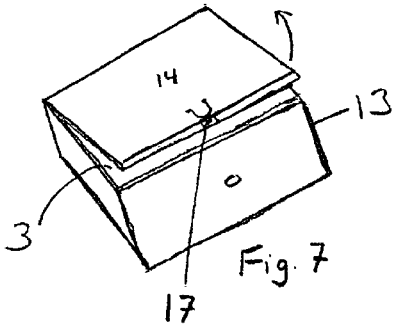
Fig. 7
Fig. 8
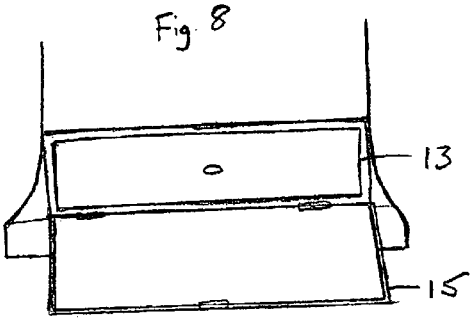

PET CREMATORY URN

TECHNICAL FIELD OF THE INVENTION

This invention relates generally to crematory urns for pets and particularly to customized crematory urns for pets.

BACKGROUND OF THE INVENTION

Cremation is a means of disposing of the remains of the deceased. From time immemorial, various vessels such as vases, jars and urns have been used as a repository for the cremated remains of humans. Many of these retainers pay tribute to a deceased individual through various means. Some urns are made with ornate decorations and fitted with jewelry, while others are formed in the likeness of cherished objects.

Although the prior art teaches many improvements to cremation urns for human remains, there are scant few disclosures of cremation urns for pets. For example, the art of human cremation urns, as previously disclosed, includes, U.S. Pat. No. 2,562,726, teaching an urn for ashes with a screw in stopper; U.S. Pat. Nos. 2,385,520, 2,235,617, and 2,075,859 teaching cremation urns with a screw-in stoppers; U.S. Pat. No. 4,324,026 teaching an urn with compartment for memorabilia of the deceased; and U.S. Pat. Des. No. 232,782 teaching an urn formed as a statue or bust. All of the above referenced art is with respect to vessels for human remains and not animals and specifically pets.

As this indicates, pet owners have had very few choices in electing to preserve the ashes of a beloved pet. Given the means, however, pet owners would choose to preserve their pet's cremated remains in an urn that evokes the likeness and the particular physical attributes and memories of a cherished pet. An urn bearing a close or nearly exact likeness of a family or personal pet would be a preferred means to keep alive the memories of one's pet. Presently, there are very few devices designed for storing and preserving the ashes of a beloved pet. In this regard, there are even fewer choices for pet urns that also memorialize the pet in a three-dimensional representation of the pet's likeness. The present invention provides a final resting place for the remains of a cherished pet in an urn customized in the form of the pet's likeness and that provides an improved means for accessing the repository chamber in which the ashes are stored.

History teaches that human beings have a tendency to form strong emotional attachments to specially chosen pets. Only recently, however, have pet owners had the freedom of resources to treat their pets to many of perquisites usually reserved for humans. Pet owners now provide for their pets in lavish and sometimes exorbitant ways, including custom-built air-conditioned doghouses, treatments by animal psychologists, luxurious grooming, hairstyling and polishing of nails, etc. Accordingly, the industry catering to specialty pet products and services has seen tremendous growth in recent years.

This trend of treating one's pet in every respect as family member has produced a need for providing pet owners with a means for memorializing the life of a cherished pet after its death. The emotional bond between owner and pet creates the need for bereavement services and funerary products for pets. This is evidenced by the increasingly popular practice of selling burial plots for pets and conducting formal internment ceremonies for the pets. The sale of pet burial plots in pet cemeteries has become a formidable business enterprise, catering to all the needs of bereaved pet owners. These practices may involve, for example, memorial services, caskets and the like in an attempt to replicate human burial ceremonies. Crematoriums have also started to cater specifically to bereaved pet owners, sometimes arranging for a fitting ceremony during which a pet's ashes may be dispersed.

Sometimes the ashes are retained in a crematory urn, typically displayed in a special place in the home of the pet owner. However, many such urns are expensive and yet do not fittingly memorialize the life of the pet. Many pet owners would find it desirable, given the means, to keep their pet's ashes in an urn that allows them to evocatively reflect upon and recollect the life of their pet. Toward that goal, the present invention provides a final resting place for the cremated remains of the pet formed in a replica of the animal whose remains are contained therein.

Among the prior art, one pet urn comprises a cremation receptacle with a decorative housing bearing a stylized likeness of a pet such as a dog or cat as disclosed in U.S. Pat. No. 6,023,822. Although this urn generally discloses a storage receptacle in the stylized likeness of the deceased pet, many of its features as a storage receptacle warrant improvement. For instance, the prior art shows a chamber for holding the ashes with an opening located, preferably on the bottom of the urn where it is difficult to access, particularly where the urn is made of a heavy material. In this case, it is necessary to turn the urn over on its side or its head in order to access the chamber opening, with the unfortunate consequence of increasing the risk of dropping and breaking the urn, particularly a heavy ceramic urn. Even more particularly, the prior art discloses a complicated threaded receptacle system wherein one chamber is threaded into a receptacle, which in turn, is then sealed by a threaded screw cap or screw plug. The above-described system, with its restricted access to the storage chamber and its difficult-to-operate sealing system provides an impediment to the use and enjoyment, as well as to the functionality of the pet urn. In so far as it is likely that many of the bereaved pet urn users are elderly and/or frail, the need for an easy to use pet urn becomes all the more important.

Moreover, the pet urns of the prior art comprise molded, sculpted, cast, or extruded material forming the decorative shell of the urn. These stylized urns of the prior art bear only a distant resemblance to the deceased pets because they lack realistic general features such as fur, whiskers as well as the individual markings that characterize the true likeness of the deceased pet. The prior art decorative housings may perform a decorative function, but they fall well short of a true likeness of the deceased pet.

It would be preferable to pet owners to have an urn that is a very close likeness of their deceased pet as opposed to a generic version of a pet breed. It would also be preferable to have a pet urn that provides ease of use and ease of access to the repository chamber. It is also preferable to develop a pet urn with the above characteristics that also has a supporting base for the urn, providing stability and an even more easily accessible chamber for the storage of ashes without the need for a separate sealable container.

SUMMARY OF THE INVENTION

This invention provides an improved devise comprising a decorative urn for the convenient reception and storage of ashes of deceased pets such that the ashes may be easily, securely and conveniently stored and displayed in the customized likeness of the deceased pet. The pet crematory urn of the present invention comprises a customized figurine or statue designed and crafted in the likeness of the deceased pet and, further, provides easy access to a repository chamber for the preservation and storage of the ashes of the pet. The present invention also provides a figurine or statue customizable to substantially the exact likeness of the deceased pet, including, at the customer's optional request, fur, whiskers, and color markings that match those of the deceased pet. Finally, the present invention also provides a process for the automation of the customization of the figurine of the present invention.

The urn of the instant invention is provided with an easily accessed repository chamber for the storage of the cremation ashes to be contained therein. The repository chamber of the present invention is the inside of the decorative likeness of the deceased pet without the need for any additional securing or holding means such as the tube described in U.S. Patent No. 6,023,822. The repository chamber, optionally, may also be contained within the decorative base/pedestal upon which the pet's statue rests, again without the need for any additional securing or holding means that encumber and complicate access to the chamber.

The chamber is conveniently accessed through a removable access means or opening formed in the pet statue, such as the head, neck, body, tail, leg or paw, for example. An inconspicuous hinged door flush with the body of the figurine may also be used to conceal access means located in the body of the pet statue. Where the cremated remains are to be deposited in the base upon which the statue rests, the access means may comprise a hinged compartment behind which is located a slidable compartment or drawer comprising the repository chamber. In any case, the opening may be securely sealed and, when closed, remains inconspicuous within the display.

BRIEF DESCRIPTION OF THE DRAWINGS

FIGS. 5–8 show the pet urn and supporting base member with views of sealable repository chambers.

DESCRIPTION OF THE PREFERRED EMBODIMENTS

Example 1

In one preferred embodiment the present invention comprises a pet urn ma nufactured in the general likeness of a particular animal species and breed in various states of repose which is subsequently further customized upon request by the customer to the specific likeness of the animal whose ashes are to be contained therein. In one practical example of this embodiment, the urn may be manufactured in the likeness of the Labrador breed of dog, whereupon the urn maybe further customized, to bear the exact likeness of the deceased pet. The more particularized customization can be accomplished by matching the markings and coloration of the urn to the deceased pet, using photographs of the deceased or other written or verbal descriptions of the features.

Recent advances in technology allow production processes to be both highly automatic and at the same time customized. For instance, computer graphical representations of the urn to be produced can be created based on photographs, verbal descriptions, or scanned images digitally superimposed on an image of an urn in the general likeness of the pet's species and breed. Those images then can be previewed by the customer and further modified to depict features that the customer requests. Finally, the graphical representation is downloaded to the production facility that produces an individualized customized urn in that exact likeness. This entire process may take place over the Internet; through email, phone calls and U.S. mail; or by in-person consultation with the customer. Moreover, pre-need urns may be produced based on the physical representation of the live pet. Alternatively, veterinarian services may conveniently provide the equipment necessary for 3D graphical imaging used in production of the present invention. One such system, the Image Data Matrix system,is described by Mechatronics PTY LTC 51 Westchester Rd. Malaga (Perth) Western Australia, P.O. Box 2294, Malaga WA 6994.

Figure 1:
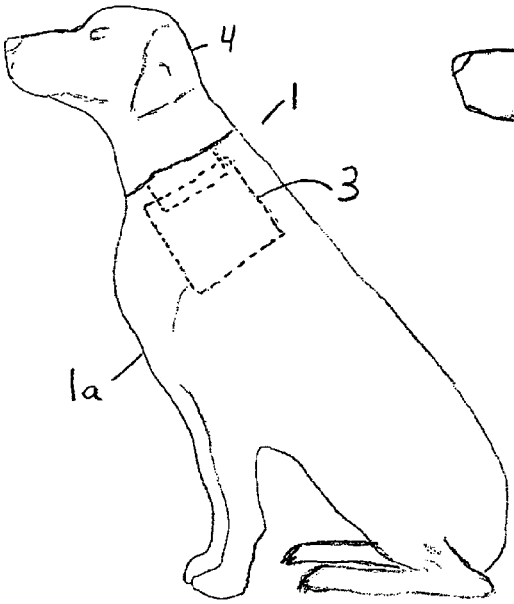
FIGS. 1–4 are profile views of various embodiments of the pet urn showing access means and cutaway views of the sealable repository chamber.
Figure 2:
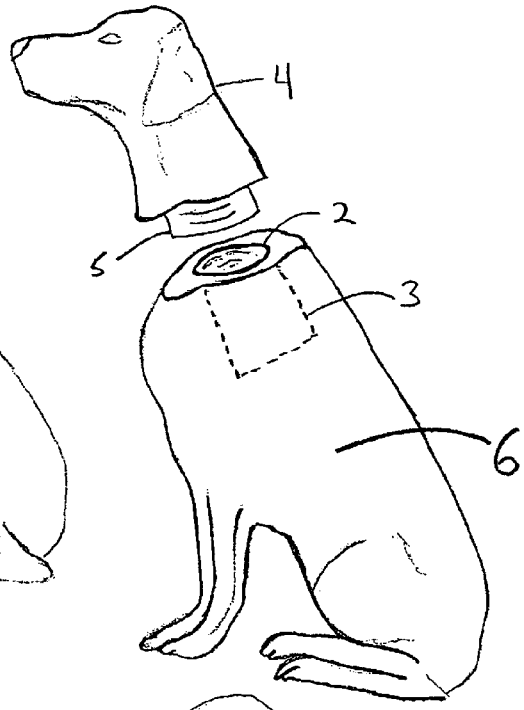

As shown in FIG. 1, the cremated remains in this embodiment are contained within the figurine representing the deceased pet 1. In this regard, the figurine serves both as the chamber 3 for the reception of the cremated remains and as a decorative housings 1*a*. In this embodiment, the opening 2 for the repository chamber 3 is formed approximately at the base of the neck of the statute. Access to the chamber is gained by removing the head portion 4 of the pet statue as shown in FIG. 2. The head portion is securely fitted by known means 5, such as threaded female and male adaptations, friction plug, cork, decanter, or the like. Thus, the purchaser of the present urn may gain access to the repository chamber via the access means 2, 4, 5 without having to lift or move the urn. Moreover, the head portion 4 of the figurine is of sufficient size so that it is not difficult for elderly or frail users to grasp, manipulate and remove it.

Example 2

Figure 3:
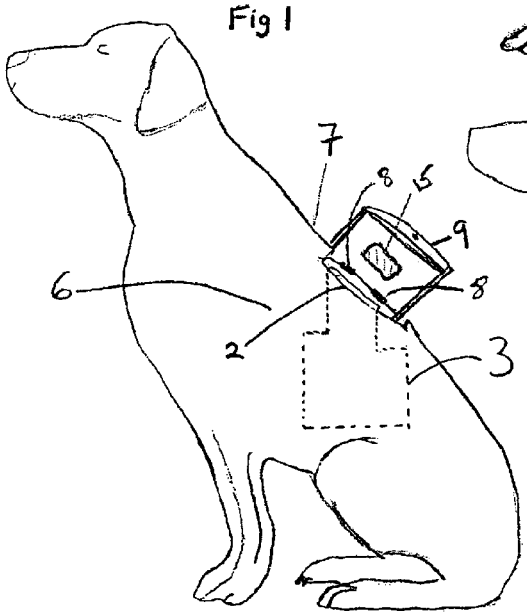

This embodiment is substantially the same as the previous example, except that the access means for the repository chamber 3 is located on the body 6 of the customized figurine, for example on its back 7, in an inconspicuous manner. As shown in FIG. 3, the cover 9 may be hinged 8 and provide easy access to the repository chamber 3 without having to lift the urn. In this example as in the previous example, the cover 9 is of sufficient size and appropriate design to provide easy and convenient access. In this regard, the hinged covering 9 need only be provided with a slight lifting force to reveal the repository opening 2 to the chamber 3 contained there under. The hinged covering 9 is fitted with sealing means 15, such as a rubber stopper, on the underside of the covering and adapted to fit into the opening such that closing the cover automatically engages the sealing means 15 into opening 2 thereby sealing the sealable chamber 3. As in the previous example, the access means 2, 9, 15 of the present invention provides convenient access to the repository chamber 3.

Example 3

Figure 4:
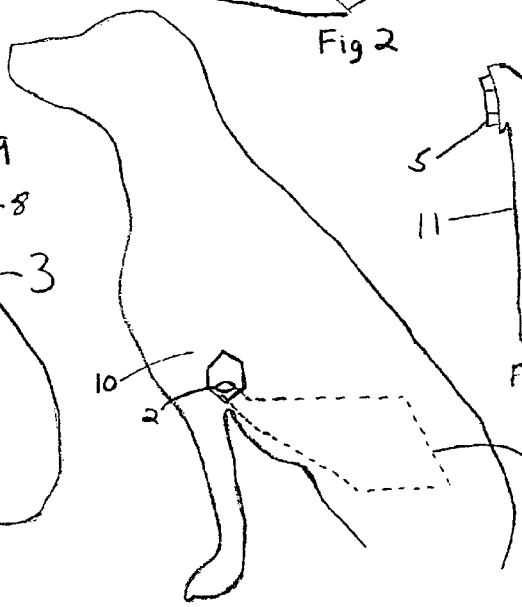
Figure 4A:
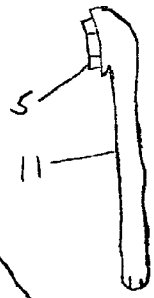

This embodiment is substantially the same as Example 2 except that the opening 2 for the repository chamber 3 is located at the shoulder 10 of the pet figurine. Removal of one of the legs 11 of the pet figurine provides access to the opening 2. As in Example 1, the leg 11, shown in FIG. 4*a*, is securely fitted by known means 5, such as threaded female and male adaptations, friction plug, cork, stopper, or the like. Thus, the purchaser of the present urn may gain access to the repository chamber via the access means 2, 5, 11 without having to lift or move the urn.

Example 4

In a third preferable embodiment, shown in the FIGS. 5–8, the cremated remains are housed in a sealable repository chamber 3 located in a base portion 12 of the urn. FIG. 5 shows the customized figurine portion 16 resting on a pedestal-like base 12, that itself may be of any shape or size, and which houses a slideable drawer 13 comprising the repository chamber 3. In this regard, the slideable drawer 13 provides a convenient means for accessing the repository chamber 3 that is independent of having to lift, move or disassemble the urn, particularly a heavy urn. The base drawer 13 in this embodiment has a sealable cover 14 for secure closure and keeping of the ashes. The sealable cover may be secured in a closed position by means 17 known in the arts, such as a single ball bearing and a bearing support mounted to the drawer wall with a concave bearing surface for receiving the ball bearing and a coil spring for urging the bearing support and ball bearing against the concave bearing. FIG. 6 shows one embodiment with a drawer 13, in the shape of a tube, comprising a sealable repository chamber 3 that slides angularly into the base portion 12 of the urn. The side circumference of the sealable cover 14 frictionally engages the top of drawer housing in the base portion 12 thereby forming the seal of the sealable repository chamber 3. FIG. 6 also shows a closeable decorative cover 15 that renders the repository chamber inconspicuous within the urn. FIG. 6*a* shows the drawer of this embodiment removed from the base, making apparent the ease of access to the opening 2 of the repository chamber 3 by slideably removing the drawer 13. FIG. 7 shows a conventional type drawer 13 with a top 14 that sealably closes the repository chamber 13. FIG. 8 shows the drawer inserted into a bottom portion of the base and a closeable decorative cover 15 to render the repository chamber inconspicuous within the urn.

In any of the above examples, the repository chamber of the present invention may be designed to sealably accept the ashes of the cremated pet directly or, as they may also be found, in a flexible container. In addition, the present invention may also be fitted with a durable removable rigid container such that the container with ashes may be securely transported.

The receptacle or urn may be made of cast material or the usual alloys for casting statues, such as bronze, ceramic material, curable resins, marble, or extrudable and thermoformed plastics and the like; but is preferably of marble, or most preferably of extrudable plastic. In all instances, the figuring portion of the urn may also be covered with a natural or synthetic fur, including whiskers, that may also be customized in length, color, and pattern representing the approximate exact likeness of the deceased animal contained therein.

Although for purposes of illustration certain material and sizes have been defined herein, those skilled in the art will recognize that various modifications to the same can be accomplished without departing from the spirit of the present invention and such modifications are clearly contemplated herein.

What is claimed is:

1. A process for the manufacture of a pet crematory urn for storing the cremated remains of a deceased pet comprising:

(a) superimposing a digital graphical image of the likeness of the deceased pet on a digital representation of a general likeness of the deceased pet's species, thereby producing a composite digital image of the deceased pet;

(b) transmitting the composite image to a production facility;

(c) using the transmitted composite digital image to produce the pet crematory urn wherein pet crematory urn is a replicated likeness of the deceased pet;

(d) placing the cremated remains of the deceased pet in the pet crematory urn through an access means and (e) sealing the access means of the urn.

2. The process of claim 1 wherein said access means is disposed in the neck portion of the replicated likeness of the deceased pet.

3. The process of claim 1 wherein said access means is disposed in the back portion of the replicated likeness of the deceased pet.

4. The process of claim 1 wherein said access means is disposed in the torso portion of the replicated likeness of the deceased pet.

5. The process of claim 1 wherein said access means is disposed in the leg portion of the replicated likeness of the deceased pet.

* * * * *